US007048485B2

(12) United States Patent
Dean, Sr. et al.

(10) Patent No.: US 7,048,485 B2
(45) Date of Patent: May 23, 2006

(54) TELESCOPIC RESTRAINING BRACE FOR CARGO

(76) Inventors: Patrick L. Dean, Sr., 7575 Tippin Ave., Pensacola, FL (US) 32514; Fred Ivon Curnow, 195 County Road 158, Floresville, TX (US) 78114

( * ) Notice: Subject to any disclaimer, the term of this patent is extended or adjusted under 35 U.S.C. 154(b) by 0 days.

(21) Appl. No.: 10/796,361

(22) Filed: Mar. 9, 2004

(65) Prior Publication Data

US 2005/0201842 A1 Sep. 15, 2005

(51) Int. Cl.
*B60P 7/08* (2006.01)

(52) U.S. Cl. ..... 410/129; 410/121; 410/151

(58) Field of Classification Search ..... 410/121, 410/129, 127, 151, 140, 143; 211/105.3, 211/105.4; 224/403, 404; 248/354.1, 354.3, 248/354.4, 354.5, 354.6, 354.7
See application file for complete search history.

(56) References Cited

U.S. PATENT DOCUMENTS 3,049,328 A * 8/1962 Bishop
3,912,139 A * 10/1975 Bowman ..... 410/3
4,236,854 A * 12/1980 Rogers ..... 410/121
4,434,970 A * 3/1984 Boland et al. ..... 254/108
4,492,499 A * 1/1985 Gasper ..... 410/32
4,772,165 A * 9/1988 Bartkus ..... 410/139
5,351,926 A * 10/1994 Moses ..... 248/354.5
5,697,742 A * 12/1997 House ..... 410/127
5,934,850 A * 8/1999 Soumar et al. ..... 410/155
5,997,228 A * 12/1999 Potter ..... 410/155
6,068,433 A * 5/2000 Baloga ..... 410/145
6,186,715 B1 * 2/2001 Oliviero ..... 410/151
6,238,154 B1 * 5/2001 DaProto ..... 410/151
6,582,169 B1 * 6/2003 Cano-Rodriguez et al. . 410/128

* cited by examiner

*Primary Examiner*—Stephen Gordon
(74) *Attorney, Agent, or Firm*—Jackson Walker L.L.P.; Mark A. Tidwell, Esq.

(57) ABSTRACT

A telescoping cargo brace is disclosed in which the brace secures cargo on at least three sides while minimizing the use of walls or contact points to secure the cargo. The brace is a fork-shaped or u-shaped telescoping device that secures between adjacent walls of a storage container or transport vehicle. The forked shaped portion of the device has two parallel, spaced apart legs each of which telescopes perpendicularly from a shared cross-member. Likewise, each leg is telescoping. Thus, both the legs and the cross-member are scalable along their respective lengths to adjust to the size of a load of cargo. The brace also includes a third telescoping leg, opposite the fork-shaped portion, so as to permit the device to be installed between adjacent walls utilizing only three contact points. An adjustment mechanism controls extension of the telescoping legs and the outward pressure exerted on the walls by the brace.

41 Claims, 1 Drawing Sheet

Fig. 1
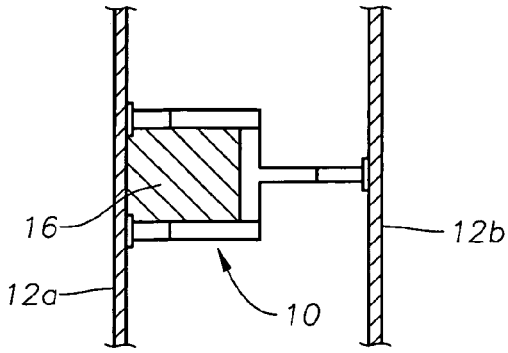
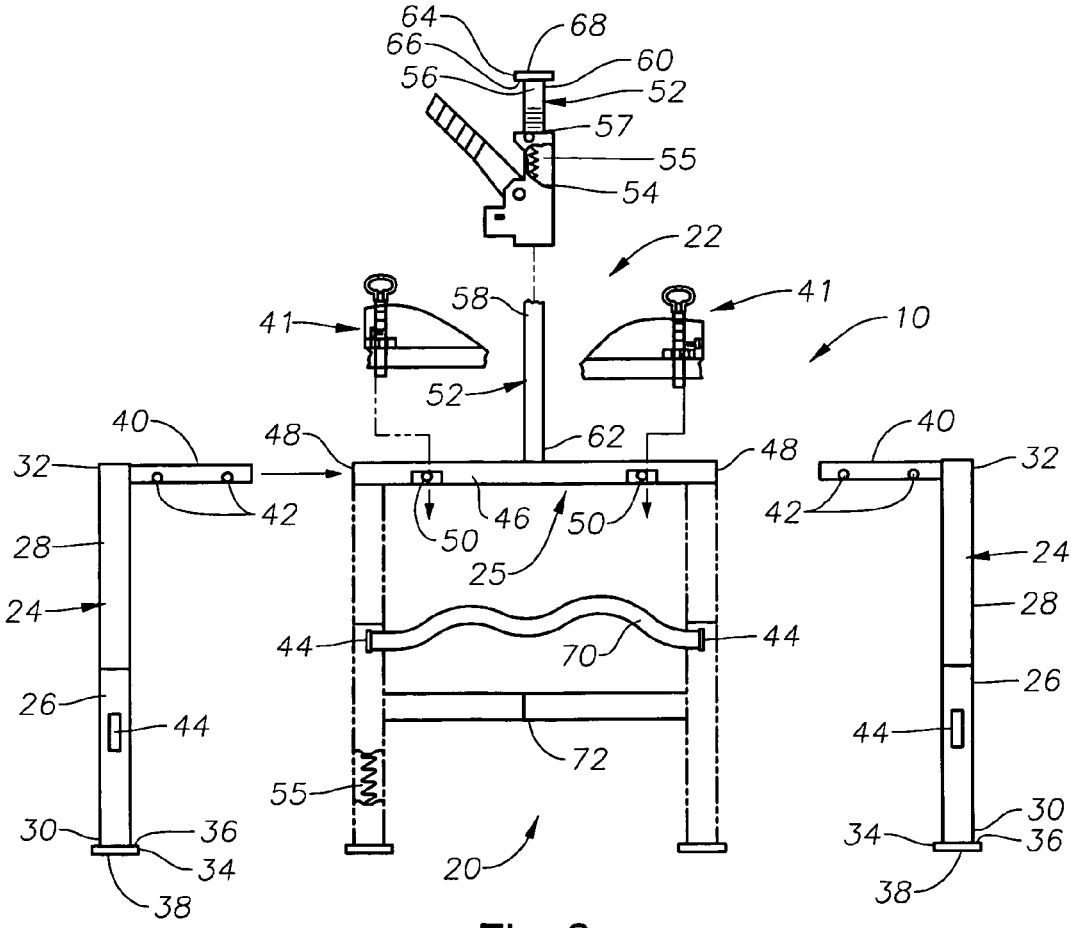
Fig. 2

TELESCOPIC RESTRAINING BRACE FOR CARGO

FIELD OF THE INVENTION

The present invention relates to the field of cargo and loading restraining devices for preventing shifting of loads or cargo in vehicles and containers. More particularly, the invention relates to an easily installable and adjustable telescoping load restraining apparatus that is capable of inhibiting both lateral movement and longitudinal movement of a cargo load while minimizing the contact points between the apparatus and the vehicles or containers.

DESCRIPTION OF THE PRIOR ART

A common problem with the carrying of freight or cargo in vehicles, especially in tractor trailers, is shifting or movement of the cargo load when driving, especially with less than a full load. In such cases, a single item or small numbers of items can shift laterally from side-to-side or longitudinally backward and forward or vertically up and down. Such unrestrained loads may slide forward against the back of the vehicle's cab or even bounce out of an open vehicle into the paths of other vehicles during sudden stops, starts or turns. In any event, such movement can cause damage to the cargo, to the transport vehicle and other vehicles, to public and private property, and possible injury to people such as the driver or passengers.

In the cargo restraint arts, a substantial array of devices have been devised to prevent cargo from moving inside a vehicle or container during transport. These devices are constructed and arranged within the vehicle or container and about the cargo so as to inhibit lateral, longitudinal, vertical and off-axis movement. One common problem has been the bracing of cargo in a container when the cargo does not completely fill the container. Without being properly braced, any movement of the container can cause the cargo to shift about inside the container thereby causing damage to both the cargo and container.

Often a cargo load will include items of varying shapes, sizes, weights and centers of gravity, and as such, have different bracing requirements within a vehicle or container. This cargo may typically include square or rectangular articles such as boxes, cylindrical articles such as barrels, or relatively thin articles such as wood, mattresses, or the like. Likewise, the cargo may be arranged on pallets or stacked freely in the trailer. Additionally, cargo may be top heavy or unstable. Accordingly, cargo restraint devices must be capable of securing cargos having a wide range of specifications.

Various conventional bracing devices have been disclosed. Virtually all are designed to prevent the load from shifting in a longitudinal or front-to-back direction, and more particularly, to prevent the load from moving backward under forward movement of the vehicle. Thus, the majority of said prior art cargo braces are designed to be positioned laterally across the inside of the vehicle, and abut the rear-facing side of the cargo. They are commonly secured utilizing either an outward friction force against the vehicle walls or are attached to hardware or structures mounted on the walls. More specifically, these prior art cargo restraint devices typically consist of bars or panels that attach to or abut opposing walls of a transport vehicle, thereby restraining the cargo to movement in a direction parallel to the bars or panels. In this configuration, the restraint device contacts the cargo on only one side, such as the reward side of the cargo. A similar device may be likewise secured abutting the forward side of the cargo. For such devices, the cargo is kept from shifting laterally solely by the wall of the vehicle and any other cargo that is positioned laterally against it. When adjacent cargo is removed, a gap then exists in the space from where the cargo was removed.

To inhibit lateral movement, cross-bar and cross-panel members are often attached perpendicular to the bars and panels, thus forming a "grid" abutting the cargo on opposing sides, and thereby restrain the cargo from movement parallel to the cross-rods and cross-panels, i.e., lateral movement.

These various prior art cargo braces have several drawbacks. Some devices contact the cargo over a limited surface area or are not vertically adjustable to accommodate cargo that might have a high center of gravity. This tends to limit the size and weight of the cargo being restrained to prevent toppling. Some devices only restrict longitudinal movement with bars or panels and depend on friction or other means for restraining cargo in the lateral direction. These devices can result in the type of damage described above or lead to the use of unreliable means to restrain the cargo.

Furthermore, to the extent such restraint devices are secured between opposing walls using pressure, if the walls of the vehicle becomes warped or deformed, as is common with the flexible walls of tractor trailers, these support bars may loosen and fall out. Also, changes in air temperature often cause the support bars to become loose. For example, if support bars are installed in a geographic region having hot temperatures, the bars will contract as the vehicle travels to a geographic location having colder temperatures, thereby causing the bars to fall out.

The conventional devices used to secure loads in vehicles are also difficult to install, adjust and remove. This is particularly true of cargo loads with varying size, shape, weight or center of gravity. As a result, the securing devices may not be properly installed or adjusted, resulting in unstable loads and damaged cargo. The conventional load securing devices are also unable to effectively secure different types and sizes of loads in various locations of the vehicle.

U.S. Pat. Nos. 6,186,715 and 4,434,970 are exemplary of the standard load bracing bar of the prior art in which a bar is positioned laterally across the inside of the vehicle and abuts the cargo load. In each of these prior art references, an adjustable length cargo brace is shown in which the brace is positioned between adjacent walls of a vehicle and secured therebetween utilizing friction and a locking mechanism that forces the ends of the brace outward against the vehicle walls. Specifically, each patent teaches a device having a first bar slidingly nested in a second bar so as to telescope. A locking mechanism controls movement of the two bars relative to one another and also permits one bar to be ratcheted outward relative to the other bar. As mentioned above, a drawback to such a configuration is that such devices only apply securing pressure to one side of the cargo. As such, unless additional devices are used or the cargo is resting against other cargo or the vehicles walls, the cargo is capable of movement in at least three other horizontal directions.

To further restrain movement of cargo, various cross-member devices are typically used, such as those shown in U.S. Pat. Nos. 5,697,742 and 4,772,165. In U.S. Pat. No. 5,697,742, a telescoping cross-bar is secured between the original, laterally positioned load bracing bar and an additional wall of the vehicle, such that the cross-bar is perpendicular to the original load bracing bar. In U.S. Pat. No.

4,772,165, a telescoping cross-bar is perpendicularly secured between two parallel, laterally positioned load bracing bars. One drawback to such cross-bars is that fixation of the cross-bars requires some type of additional lateral structure, i.e., either a lateral wall or another laterally positioned load bracing bar. To the extent a second lateral bar is utilized as the fixation point, the second lateral load bracing bar must be positioned to be in the same vertical plane as the opposing parallel bar.

Rather than cross-members such as those referenced above, some prior art devices simply utilize clamps or arms that are slidingly mounted on the original, laterally positioned load bracing bar and extend therefrom to abut the cargo on an additional side. Each of U.S. Pat. Nos. 6,238,154; 5,934,850 and 5,997,228 teach such a device. Specifically, in U.S. Pat. Nos. 6,238,154 and 5,934,850, a restraining arm is mounted on the load bracing bar and can be moved and secured along the load bracing bar as necessary to accommodate cargo of varying sizes. Typically, such arms are used in pairs so as to provide support on opposite sides of a load. Similarly, in U.S. Pat. No. 5,997,228, lock blocks are utilized rather than bracing arms. The lock blocks must be specifically notched or configured to fit the surface of cargo and are most effective when use in multiple pairs with multiple lateral load bracing bars.

It would be desirable to provide a cargo securing device that can secure cargo on at least three sides without the need for more than two fixation walls or multiple bracing bars. Such a device should be easy to install and readily adjustable for both width and length. Furthermore, such a device should be capable of securement without special preparation or configuration of the transport vehicle or container.

SUMMARY OF THE INVENTION

These and other objects are achieved through the telescopic restraining cargo brace of the present invention. The brace is a fork-shaped or u-shaped telescoping device that secures between adjacent walls of a storage container or transport vehicle, such as a tractor trailer. The forked shaped portion of the device has two parallel, spaced apart legs joined together by a cross-member. Each of the legs is telescoping. Likewise, the cross-member adjoining the legs is telescoping. Thus, both the legs and the cross-member are scalable along their respective lengths to adjust to the size of a load of cargo.

Also extending from the cross-member, in the same plane as the legs but in a direction opposite from the legs, is a telescoping locking bar. The telescoping locking bar includes nested tubes and an adjustment mechanism to control movement of the nested tubes relative to one another so that the distal ends of the telescoping locking bar and the two parallel legs can be secured by friction between adjacent walls of a cargo container or transport vehicle.

In one embodiment of the invention, the adjustment mechanism is a ratchet device that permits incremental movement of the nested tubes of the telescoping locking bar. In another embodiment, the adjustment mechanism is capable of maintaining sufficient securing friction force against opposing walls even when the walls contort during movement of the vehicle. In yet another embodiment of the invention, a flexible securing strap can be attached between the parallel legs so as to wrap over the top of the cargo and further restrain vertical movement of the cargo.

BRIEF DESCRIPTION OF THE DRAWINGS

FIG. 1 is a top view of the restraining brace secured around a cargo load.

FIG. 2 is an exploded top view of the restraining brace.

DETAILED DESCRIPTION OF THE PREFERRED EMBODIMENTS

In the detailed description of the invention, like numerals are employed to designate like parts throughout. Various items of equipment, such as fasteners, fittings, etc., may be omitted to simplify the description. However, those skilled in the art will realize that such conventional equipment can be employed as desired.

Illustrated in FIG. 1 is the restraining brace 10 of the invention secured between opposing walls 12*a*, 12*b* of a cargo transport vehicle (not shown). Restraining brace 10 is disposed around three sides of cargo 16. In the illustrated embodiment of the invention, a forth side of cargo 16 is urged by brace 10 against one of the walls 12 of the cargo transport vehicle.

With reference to FIG. 2, restraining brace 10 is generally comprised of a fork-shaped or u-shaped portion 20 and a locking portion 22. Forked shaped portion 20 is defined by two parallel, spaced apart legs 24 and a cross-member 25. Each leg 24 is comprised of a first tube 26 axially nested inside a second tube 28 such that tubes 26, 28 are capable of telescoping movement relative to one another. Tube 26 includes adjustment elements (not shown) which may be apertures, teeth, or threads. In another embodiment, the adjustment elements are apertures in which a spring loaded pin can seat. In yet another embodiment, the adjustment elements are teeth that can be engaged by a ratchet mechanism. Each leg 24 is further defined by a distal end 30 and a proximal end 32. Attached to the distal end 30 of leg 24 is a mounting foot 34. Mounting foot 34 may include a rigid plate 36 on which is mounted an outwardly facing friction pad 38. Friction pad 38 may be rubber or a similar material to enhance friction between walls 12 and brace 10. Extending from the proximal end 32 of each leg 24 is a shaft 40. Shaft 40 is mounted on leg 24 so as to extend perpendicular therefrom. In the illustrated embodiment, shaft 40 includes a plurality of adjustment apertures 42. Those skilled in the art will appreciate that in an alternative embodiment, shaft 40 may include a plurality of teeth or similar device to permit finer adjustments of leg 24, as described in more detail below, than would be permitted by the coarser adjustment apertures 42. In any event, one or more attachment anchors 44 may be positioned along the length of leg 24.

Cross-member 25 is comprised of a tube 46 having opposite, hollow open ends 48. Each end 48 of tube 46 is disposed to receive the free end of shaft 40 of a leg 24 such that shaft 40 is slidingly mounted within tube 46. At each end 48, tube 46 is also provided with adjustment apertures 50 such that when a shaft 40 is mounted within tube 46, adjustment aperture 50 can be aligned with a selected adjustment aperture 42 on shaft 40. When legs 24 are thus mounted to cross-member 25, each leg 24 is perpendicular to cross-member 25 and legs 24 are parallel to one another.

In the illustrated embodiment, a leg 24 is secured to cross-member 25 utilizing a spring loaded retaining pin 41 that extends through aligned apertures 42 and 50, preventing movement of shaft 40 of leg 24 relative to tube 46 of cross-member 25. In another embodiment, apertures 42 on tube 46 are replaced with teeth, threads, grooves, a rack, or similar elements and spring loaded retaining pin 41 is replaced with an adjustment mechanism as described in more detail below, such that positioning of leg 24 relative to cross-member 25 can be more incrementally controlled and adjusted to meet the size parameters of the cargo being secured.

Locking portion 22 is defined by a telescoping locking leg 52 and an adjustment mechanism 54. Telescoping locking leg 52 is comprised of a first axial tube 56 nested inside a second tube 58 such that tubes 56, 58 are capable of telescoping movement relative to one another. Tube 56 may include teeth 57, threads, grooves, a rack, apertures or similar elements that permits tube 56 to be incrementally moved relative to tube 58. Leg 52 is defined by a distal end 60 and a proximal end 62. Attached to the distal end 60 of leg 52 is a mounting foot 64. Mounting foot 64 may include a rigid plate 66 on which is mounted an outwardly facing friction pad 68 similar to friction pad 38 described above. Proximal end 62 of leg 52 is perpendicularly attached to cross-member 25 so as to extend from cross-member 25 in a direction opposite legs 24. Preferably, proximal end 62 is attached to cross-member 25 approximately midway between ends 48 of cross-member 25.

Although adjustment mechanism 54 can be any type of device that can be used to secure nested tubes 56, 58 to one another, in the preferred embodiment, adjustment mechanism 54 is a ratchet device that can incrementally control movement of the nested tubes 56, 58 relative to one another. In this regard, adjustment mechanism 54 is secured to tube 58 and engages teeth 57 of tube 56 such that operation of the adjustment mechanism 54 urges tube 56 axially outward from tube 58. Adjustment mechanism 54 thus permits the friction force exerted against opposing vehicle walls 12*a*, 12*b* by feet 34, 64 to be controlled.

In another preferred embodiment, adjustment mechanism 54 further includes a biasing mechanism or control mechanism 55 that is capable of maintaining sufficient securing friction force against opposing walls even when the walls contort during movement of the vehicle. In still yet another embodiment, adjustment mechanism 54 may include threads (not shown) that engage threads 57 on tube 56 or adjustment mechanism 54 may simply consist of corresponding internal threads in tube 58. Those skilled in the art will appreciate that incremental adjustments utilizing threaded components often permit finer adjustments than are capable with a ratchet configuration. In this embodiment, adjustment mechanism 54 may also include a locking device to secure the meshed, threaded components once they have been adjusted as desired. In still yet another embodiment, adjustment mechanism 54 is comprised of a spring loaded retaining pin mounted on tube 58. The spring loaded restraining pin is urged against tube 56 such that a portion of the pin can seat in the desired corresponding adjustment aperture 57 provided in tube 56.

A securing element 70 may also be provided, wherein element 70 can be attached between legs 24 utilizing attachment anchors 44 such that securing element 70 can be extended over the top of the cargo to further restrain vertical movement of the cargo around the unrestrained side of the cargo to further restrain lateral movement. In one preferred embodiment, securing element 70 is a flexible strap that can be wrapped over the top of the cargo. Securing element 70 may also be a more rigid structure, such as a bar or semi-rigid strap.

The restraining brace 10 as described above (except to the extent securing element 70 is used) is capable of securely restraining a cargo load on three sides of the cargo, while pinning the forth side of the cargo against wall 12 of the cargo transport vehicle. In another embodiment, however, brace 10 may include an additional cross-member 72 that can be selectively positioned to extend between legs 24 at a desired position along their length such that the placement of a cargo load between walls 12*a*, 12*b* can be laterally adjusted. When installed cross member 72 may be parallel to cross member 25 or off axis from cross member 25 so as to accommodate various shaped cargo. Cross member 72 is also telescoping so as to accommodate with cross-member 72 in place, brace 10 can restrain a cargo load on four sides.

The restraining brace 10 as described above is suitable for use in most cargo containment structures, including cargo containers such as standard shipping and transport containers, as well as transport vehicles such as tractor trailers, trucks, vans and the like. The restraining brace only utilizes two walls for installation, but provides a brace that is suitably stable due to the three contact points on the two walls so as to secure cargo loads. Furthermore, the configuration minimizes the complexity of prior art braces that require four or more contact points or three walls for installation. Thus, it is easier to install and adjust than prior art restraining devices capable of the same amount of bracing. In this same vein, since legs 24 are secured to the same cross-member, the brace avoids the problem of placement common with separate parallel lateral bars used in the prior art. As described, the width of the legs 24 from one another and the length of the legs 24 is adjustable to fit around cargo of different sizes so that cargo can be securely bounded on at least three sides by the brace.

While certain features and embodiments of the invention have been described in detail herein, it will be readily understood that the invention encompasses all modifications and enhancements within the scope and spirit of the following claims.

What is claimed is:

1. A cargo restraining brace comprising:

A. a fork-shaped portion defined by two parallel, spaced apart legs extending perpendicularly from a cross-member; and B. a locking portion extending from said cross-member in a direction substantially opposite said parallel legs, said locking portion comprising a telescoping locking leg and an adjustment mechanism, C. wherein each leg is comprised of a first tube axially nested inside a second tube such that said first tube is capable of telescoping movement relative to said second tube.

2. A cargo restraining brace comprising:

A. a fork-shaped portion defined by two parallel, spaced apart legs extending perpendicularly from a cross-member; and B. a locking portion extending from said cross-member in a direction substantially opposite said parallel legs, said locking portion comprising a telescoping locking leg and an adjustment mechanism, C. wherein each parallel leg is further defined by a distal end and a proximal end and a shaft perpendicularly extending from the proximal end of said parallel leg.

3. The cargo restraining brace of claim 2, wherein said perpendicularly extending shaft is provided with a plurality of adjustment elements along at least a portion of its length.

4. The cargo restraining brace of claim 3, wherein said adjustment elements are apertures.

5. The cargo restraining brace of claim 3, wherein said adjustment elements are teeth.

6. The cargo restraining brace of claim 3, wherein said adjustment elements are threads.

7. The cargo restraining brace of claim 2, wherein each parallel leg further comprises a securing foot attached to the distal end of said parallel leg.

8. The cargo restraining brace of claim 7, wherein each securing foot comprises a rigid plate perpendicularly attached to said respective leg and an outwardly facing friction pad mounted on said rigid plate.

9. The cargo restraining brace of claim 8, wherein said friction pad is rubber.

10. The cargo restraining brace of claim 2, wherein said cross-member is defined by opposite, open ends each of which is disposed to slidingly receive an end of said shaft of said respective leg.

11. The cargo restraining brace of claim 10, wherein each of said cross-member open ends is provided with an adjustment element and the end of said shaft of each respective leg is provided with a plurality of adjustment elements.

12. The cargo restraining brace of claim 11, wherein said adjustment elements of the cross-member and the respective legs are apertures.

13. The cargo restraining brace of claim 11, wherein said adjustment elements of the cross-member and the respective legs are threads.

14. The cargo restraining brace of claim 10, further comprising a locking mechanism to secure said shaft of said leg to said cross-member and a plurality of adjustment elements along at least a portion of the length of said shaft.

15. The cargo restraining brace of claim 14, wherein said locking mechanism is a spring loaded pin.

16. The cargo restraining brace of claim 14, wherein said adjustment elements are apertures and said locking mechanism is a spring loaded pin that seats in said apertures.

17. The cargo restraining brace of claim 14, wherein said adjustment elements are teeth and said locking mechanism is a ratchet that engages said teeth.

18. The cargo restraining brace of claim 1, wherein the first tube of a one of said parallel legs is provided with a plurality of adjustment elements along at least a portion of said first tube's length.

19. The cargo restraining brace of claim 18, wherein said adjustment elements are apertures.

20. The cargo restraining brace of claim 18, wherein said adjustment elements are teeth.

21. The cargo restraining brace of claim 18, wherein said adjustment elements are threads.

22. The cargo restraining brace of claim 1, further comprising a locking mechanism to secure the first tube of each said parallel leg to said respective second tube of each said parallel leg.

23. The cargo restraining brace of claim 18, wherein said adjustment elements are apertures and further comprising a spring loaded pin that seats in said apertures.

24. The cargo restraining brace of claim 18, wherein said adjustment elements are teeth and further comprising a ratchet that engages said teeth.

25. A cargo restraining brace comprising:

A. a fork-shaped portion defined by two parallel, spaced apart legs extending perpendicularly from a cross-member; and B. a locking portion extending from said cross-member in a direction substantially opposite said parallel legs, said locking portion comprising a telescoping locking leg, defined by a distal end and a proximal end such that said telescoping locking leg is attached to said cross-member at said proximal end of said telescoping locking leg, and a ratchet mechanism capable of incrementally moving said telescoping locking leg upon actuation of said ratchet mechanism, C. wherein said telescoping locking leg comprises a first tube, a second tube such that said first tube is axially nested inside said second tube and said tubes are capable of telescoping movement relative to one another, and a securing foot attached to the distal end of said telescoping locking leg, said securing foot comprising a rigid plate perpendicularly attached to said telescoping locking leg and an outwardly facing friction pad mounted on said rigid plate.

26. The cargo restraining brace of claim 25, wherein said friction pad is rubber.

27. The cargo restraining brace of claim 2, wherein said adjustment mechanism is an aperture, said cargo restraining brace further comprising a spring loaded pin that seats in said aperture.

28. The cargo restraining brace of claim 2, wherein said adjustment mechanism is teeth, said cargo restraining brace further comprising a ratchet that engages said teeth.

29. The cargo restraining brace of claim 1 further comprising an additional cross-member extending between said parallel legs, said additional cross member capable of being secured selectively along the length of said parallel legs.

30. The cargo restraining brace of claim 29 wherein said additional cross member is secured between the first tubes of said parallel legs.

31. A cargo restraining brace comprising:

A. three telescoping legs, each leg having a first tube axially nested inside a second tube such that each of said first tubes is capable of telescoping movement relative to the respective second tube in which it is nested;

B. a first cross-member defined by first and second ends, wherein one of said telescoping legs is perpendicularly attached to said cross member at a point between said ends and extends in a first direction and wherein each end of said cross member has another one of said telescoping legs telescopingly attached perpendicularly thereto such that said another ones of said legs extend perpendicularly from said cross member and parallel with one another and in a direction opposite said first direction; and C. a locking mechanism to secure said first and second tubes of one of said legs to one another.

32. The cargo restraining brace of claim 31, wherein said first tube of one of said legs is provided with a plurality of adjustment elements along at least a portion of its length.

33. The cargo restraining brace of claim 32, wherein said adjustment elements are apertures.

34. The cargo restraining brace of claim 32, wherein said adjustment elements are teeth.

35. The cargo restraining brace of claim 32, wherein said adjustment elements are threads.

36. The cargo restraining brace of claim 32, wherein said adjustment elements are apertures and further comprising a spring loaded pin that seats in said apertures.

37. The cargo restraining brace of claim 32, wherein said adjustment elements are teeth and further comprising a ratchet that engages said teeth.

38. The cargo restraining brace of claim 31 further comprising a biasing mechanism in at least one of said legs to urge at least one said leg outward.

39. The cargo restraining brace of claim 31 further comprising an additional cross-member extending between said parallel legs, said additional cross member capable of being secured selectively along the length of said parallel legs.

40. The cargo restraining brace of claim 39 wherein said additional cross member is secured between the first tubes of said parallel legs.

41. A cargo restraining brace comprising:

A. no more than three telescoping legs, each leg having a first tube axially nested inside a second tube such that each of said first tubes is capable of telescoping movement relative to the respective second tube in which it is nested;

B. a first cross-member defined by first and second ends, wherein a first one of said telescoping legs is perpendicularly attached to said cross member at a point between said ends and extends in a first direction and wherein each end of said cross member has another one of said telescoping legs telescopingly attached perpendicularly thereto such that said another ones of said legs extend perpendicularly from said cross member and parallel with one another in a direction opposite said first direction; and C. a locking mechanism to secure said first and second tubes of one of said legs to one another.

* * * * *